US010871169B2

(12) United States Patent
Maroccia

(10) Patent No.: US 10,871,169 B2
(45) Date of Patent: Dec. 22, 2020

(54) VOLUTE CASING FOR A CENTRIFUGAL PUMP AND CENTRIFUGAL PUMP

(71) Applicant: Sulzer Management AG, Winterthur (CH)

(72) Inventor: Bruno Maroccia, Winterthur (CH)

(73) Assignee: SULZER MANAGEMENT AG, Winterthur (CH)

( * ) Notice: Subject to any disclaimer, the term of this patent is extended or adjusted under 35 U.S.C. 154(b) by 372 days.

(21) Appl. No.: 15/956,186

(22) Filed: Apr. 18, 2018

(65) Prior Publication Data

US 2018/0328380 A1 Nov. 15, 2018

(30) Foreign Application Priority Data

May 9, 2017 (EP) ..... 17170250

(51) Int. Cl.
*F04D 29/42* (2006.01)
*F04D 29/66* (2006.01)
(Continued)

(52) U.S. Cl.
CPC ..... *F04D 29/4233* (2013.01); *F04D 29/428* (2013.01); *F04D 29/445* (2013.01); *F04D 29/663* (2013.01); *F04D 29/669* (2013.01); *F04D 1/00* (2013.01); *F05D 2240/121* (2013.01); *F05D 2260/96* (2013.01)

(58) Field of Classification Search
CPC ..... F04D 29/428; F04D 29/66; F04D 29/445
See application file for complete search history.

(56) References Cited

U.S. PATENT DOCUMENTS 6,017,187 A * 1/2000 Mueller ..... F04D 29/428 415/208.1
2013/0058774 A1* 3/2013 Fluckiger ..... F04D 29/428 415/204

FOREIGN PATENT DOCUMENTS

CH 428444 A1 1/1967
CN 202646156 U 1/2013
(Continued)

OTHER PUBLICATIONS

Extended European Search Report dated Nov. 22, 2017 in corresponding European Patent Application No. 17170250.9, filed May 9, 2017.

*Primary Examiner* — Moshe Wilensky
*Assistant Examiner* — Cameron A Corday
(74) *Attorney, Agent, or Firm* — Global IP Counselors, LLP

(57) ABSTRACT

A volute casing includes a chamber, an outlet passage, and a cutwater to direct fluid to the outlet passage. The cutwater includes an inner surface, an outer surface and a leading edge joining the inner and outer surfaces and has a cross-sectional contour in a midplane perpendicular to the axial direction. The cross-sectional contour includes a starting point at the leading edge, and a minimum point on the inner surface, the starting point defined by a tangent to the leading edge, the tangent intersecting the central axis, and the minimum point defined by a location, at which the inner surface has a minimum distance from the central axis. A straight profile chord located in the cross-sectional contour, and extending from the cutwater starting point to the cutwater minimum point, has a maximum orthogonal distance from the inner surface being at most 15% of the length of the profile chord.

13 Claims, 2 Drawing Sheets

(51) Int. Cl.
*F04D 29/44* (2006.01)
*F04D 1/00* (2006.01)

(56) References Cited

FOREIGN PATENT DOCUMENTS

| | | | |
|---|---|---|---|
| CN | 204419706 | U | 6/2015 |
| CN | 204572561 | U | 8/2015 |
| WO | 2011138188 | A1 | 11/2011 |

* cited by examiner

VOLUTE CASING FOR A CENTRIFUGAL PUMP AND CENTRIFUGAL PUMP

CROSS-REFERENCE TO RELATED APPLICATION

This application claims priority to European Application No. 17170250.9, filed May 9, 2017, the contents of which are hereby incorporated herein by reference.

BACKGROUND

Field of the Invention

The invention relates to a volute casing for a centrifugal pump and to a centrifugal pump.

Background of the Invention

Centrifugal pumps with volute casings are used for many different applications. The characteristic feature of a volute casing is a volute chamber for receiving the impeller of the pump, wherein the distance between the inner wall delimiting the volute chamber and the central axis of the volute casing (the axis about which the impeller rotates during operation) increases when viewed in the flow direction towards the outlet passage of the volute casing. Centrifugal pumps with a volute casing may be designed as single stage or multistage pumps, with a single suction design or a double suction design on the first stage. The fluid, e.g. a liquid, to be conveyed by the pump enters the volute casing through one or more inlet(s), is acted upon by the impeller(s) of the pump and leaves the pump through the outlet passage. For directing the fluid to the outlet passage the volute casing comprises at least one cutwater that is also referred to as cutwater tongue or tongue or splitter rib.

It is also known to design a volute casing with two cutwaters which are displaced by approximately 180° relative to each other when viewed in the circumferential direction of the volute casing. The design with two cutwaters is mainly used to balance the impeller with respect to the radial direction, i.e. to reduce the radial thrust that has to be carried by the radial bearing for the impeller. Due to the considerably uneven pressure and flow distribution at the exit, i.e. at the entrance to the outlet passage a considerable radial force acts on the impeller which is directed towards the exit. By providing two cutwaters displaced by 180° this radial thrust can be balanced, or the resulting radial thrust may be at least considerably reduced.

A known problem of volute casings is the occurrence of cavitation, in particular at the cutwater where the liquid has a very high flow velocity. The high flow velocity may decrease the local pressure below the vapor pressure of the liquid which results in the formation of gas bubbles. The gas bubbles will implode thereby generating strong pressure blows. This phenomenon is also as known as casing cavitation and has several negative impacts, for example increased vibrations and noise of the pump, a reduced differential head, instabilities in the head performance curve and severe erosion at the casing reducing the lifetime of the casing.

The risk of cavitation is particularly high when the pump is operated off the best efficiency point, for example at part-load when the pump generates a flow rate which is remarkably below the flow rate the pump is designed for, or at over-load when the pump generates a flow rate that is considerably higher than the flow rate the pump is designed for. One distinct peculiarity of such operations away from the best efficiency point is the mismatch between the flow angle and cutwater angle, which results in localized flow velocity peaks with the magnitude of the velocity peak usually increasing with increasing distance from the best efficiency point or from the design flow rate, respectively.

As practice shows, centrifugal pumps are quite often operated off the best efficiency point, in particular at part-load. The part-load operation considerably enhances the risk of cavitation with all the negative effects, particularly at the inner surface of the cutwater(s), which is the surface facing the central axis of the volute casing.

SUMMARY

One obvious possibility to reduce the risk of cavitation is to increase the suction pressure, i.e. the pressure of the liquid at the inlet of the pump, so that for a given differential head of the pump the local pressure at the cutwater or the entrance into the outlet passage, respectively, is higher. However, increasing the suction pressure is not possible in many applications because in the majority of existing pump installations the suction pressure is a boundary condition that cannot be modified. But even if the suction pressure might be increased this requires more energy, additional equipment, efforts and costs.

Starting from this state of the art it is therefore an object of the invention to propose a volute casing for a centrifugal pump, in which the risk of cavitation is considerably reduced, in particular when the centrifugal pump is operated in a part-load region off the best efficiency point or the design flow rate, respectively. It is a further object of the invention to propose a centrifugal pump having such a volute casing.

The subject matter of the invention satisfying these objects is disclosed herein.

Thus, according to the invention a volute casing for a centrifugal pump is proposed, the volute casing having a central axis defining an axial direction, a volute chamber for receiving an impeller for rotation about the axial direction, an outlet passage for discharging a fluid, and a first cutwater for directing the fluid to the outlet passage, wherein the cutwater comprises an inner surface facing the central axis, an outer surface facing away from the central axis and a leading edge joining the inner surface and the outer surface, wherein the cutwater has a cross-sectional contour in a midplane perpendicular to the axial direction, the cross-sectional contour comprising a cutwater starting point at the leading edge, and a cutwater minimum point on the inner surface, the cutwater starting point being defined by a tangent to the leading edge, said tangent intersecting the central axis, and the cutwater minimum point being defined by a location, at which the inner surface has a minimum distance from the central axis, wherein the cutwater is designed in such a manner that a straight profile chord located in the cross-sectional contour, and extending from the cutwater starting point to the cutwater minimum point, has a maximum orthogonal distance from the inner surface, the maximum orthogonal distance being at most 15%, preferably at most 13% of the length of the profile chord.

Thus, an important aspect of the invention is the specific design of the inner surface of the cutwater in the region adjacent to the leading edge of the cutwater. It has been found that by the specific design of this cutwater area local velocity peaks occurring downstream of the leading edge of the cutwater may be at least considerably reduced. Thus, the risk of cavitation, in particular in a part-load operating range of the pump, is considerably reduced, if not eliminated at all.

The design of the inner surface of the cutwater in the region adjacent to the leading edge is described by referring to the cutwater's cross-sectional contour in the midplane of the cutwater, the midplane being the geometrical midplane perpendicular to the axial direction. It has to be noted that the design of the inner surface at the midplane is representative of the design of the entire inner surface in this area adjacent to the leading edge because the basic design does essentially not change when moving away from the midplane in the axial direction.

When moving along the inner surface of the cutwater in a downstream direction from the leading edge towards the outlet of the casing, the distance of the inner surface from the central axis continuously decreases till the cutwater minimum point where the distance reaches its minimum. When moving further in the downstream direction the distance increases again. In addition to this minimum distance from the central axis, the inner surface of the cutwater has a specific design between the leading edge and the cutwater minimum point that can be described by referring to the profile chord. The profile chord is a (imaginary) straight line in the midplane (and in the cross-sectional contour in the midplane) of the cutwater connecting the cutwater starting point with the cutwater minimum point. This straight line has a length which is the shortest distance between the cutwater starting point and the cutwater minimum point. In addition, the profile chord has a orthogonal distance from the inner surface of the cutwater, wherein said orthogonal distance varies between the cutwater starting point and the cutwater minimum point. According to the invention, the maximum orthogonal distance between the profile chord and the inner surface is at most 15% and preferably at most 13% of the length of the profile chord.

It is preferred when said maximum orthogonal distance of the profile chord from the inner surface is approximately 13% of the length of the profile chord.

Preferably, the inner surface of the cutwater is curved in such a manner that the orthogonal distance of the profile chord from the inner surface first increases when moving from the cutwater starting point to the cutwater minimum point, reaches the maximum orthogonal distance, and then decreases to zero at the cutwater minimum point.

A further advantageous measure is related to the distance between the cutwater starting point and the cutwater minimum point. It is preferred, when an angular distance between the cutwater starting point and the cutwater minimum point measured on the midplane by the angle between the tangent to the leading edge through the cutwater starting point and a straight line connecting the cutwater minimum point with the central axis is at least 5.5°, preferably at least 6.5°.

Particularly preferred, the angular distance between the cutwater starting point and the cutwater minimum point is approximately 6.5°.

Furthermore, it is advantageous, when an inclination angle measured on the midplane between the profile chord and a straight line connecting the cutwater minimum point with the central axis is at least 110°, preferably at least 114°.

Particularly preferred, the inclination angle is approximately 114°.

Furthermore, it is a preferred embodiment, when the inner surface of the cutwater is designed such that the cross-sectional contour and a basic circle are tangent to each other at the cutwater minimum point, the basic circle having its center on the central axis and a radius that equals the distance between the central axis and the cutwater minimum point.

The volute casing may be embodied with only one cutwater, namely the first cutwater or with two cutwaters. Thus, the volute casing may further comprise a second cutwater for directing the fluid to the outlet passage, wherein the second cutwater comprises an inner surface facing the central axis, an outer surface facing away from the central axis and a leading edge joining the inner surface and the outer surface, and wherein the inner surface of the second cutwater is analogously designed as the inner surface of the first cutwater at least between the leading edge and the cutwater minimum point. Preferably, the first and the second cutwater are displaced by 180° with respect to the circumferential direction of the volute casing.

According to the most preferred embodiment each cutwater is designed with the combination of the following features:

- the maximum orthogonal distance between the profile chord and the inner surface of the cutwater is at most 15%, preferably at most 13% of the length of the profile chord, and
- the angular distance between the cutwater starting point and the cutwater minimum point is at least 5.5°, preferably at least 6.5°, and
- the inclination angle of the profile cord is at least 110°, preferably at least 114°.

In addition, according to the invention, a centrifugal pump is proposed comprising a volute casing and an impeller arranged in the volute casing, wherein the volute casing is designed according to the invention.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
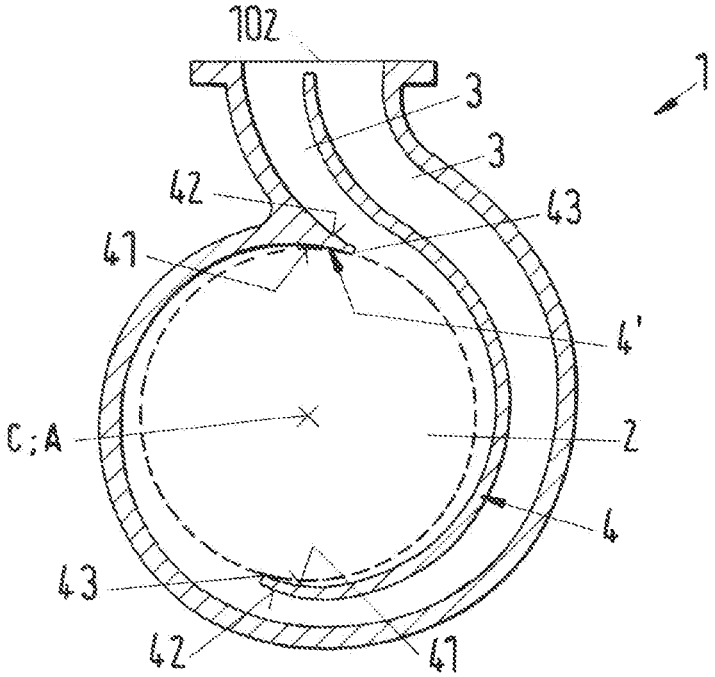
FIG. 1 is a cross-sectional schematic view of an embodiment of a volute casing according to the invention.
Figure 2:
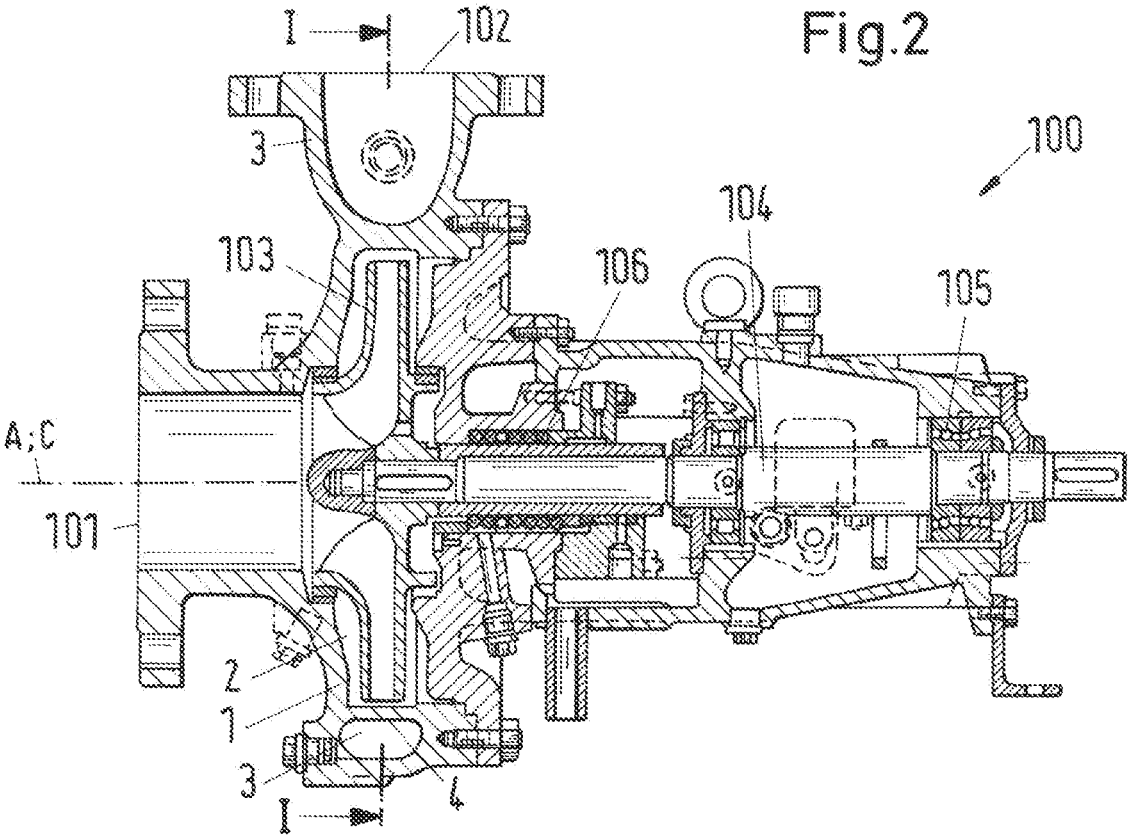
FIG. 2 is a cross-sectional view of an embodiment of a centrifugal pump according to the invention.

FIG. 1 is a cross-sectional schematic view of an embodiment of a volute casing according to the invention, which is designated in its entity with reference numeral 1. FIG. 2 is a cross-sectional view of an embodiment of a centrifugal pump according to the invention, which is designated in its entity with reference numeral 100, and which comprises the volute casing 1 shown in FIG. 1. The centrifugal pump 100 comprises an inlet 101 through which a fluid, in particular a liquid, for example water, can enter the pump 100 as well as an outlet 102 for discharging the fluid. The pump 100 further comprises at least one impeller 103 for acting on the fluid. The impeller 103 is arranged within a volute chamber 2 of the volute casing 1. During operation, the impeller 103 is rotating about a rotational axis extending in an axial direction A. The volute casing 1 comprises a central axis C coinciding with the rotational axis of the pump 100. Thus, the axial direction A is defined by the central axis C of the volute casing 1 or—what is the same—by the rotational axis about which the impeller 103 rotates during operation.

A direction perpendicular to the axial direction A is referred to as 'radial direction'. The term 'axial' or 'axially' is used with the common meaning 'in the axial direction' or 'with respect to the axial direction'. In an analogous manner the term 'radial' or 'radially' is used with the common meaning 'in the radial direction' or 'with respect to the radial direction'.

FIG. 2 shows the pump 100 in a cross-section parallel to the axial direction A, more precisely the central axis C lies in the section plane. FIG. 1 shows the volute casing 1 in a cross-section perpendicular to the axial direction A as it is indicated by the cutting line I-I in FIG. 2.

The impeller 103 is mounted on a shaft 104 in a torque proof manner. By the shaft 104 extending in axial direction A, the impeller 103 is driven during operation of the pump 100 for a rotation about the axial direction A. The shaft 104 is driven by a drive unit (not shown), for example an electric motor or any other type of motor, to which the shaft 104 is coupled. In a manner known as such, the shaft 104 and the impeller 103 are supported by a bearing unit 105. A sealing unit 106 seals the shaft 104 against leakage of the fluid along the shaft 104.

As shown in FIG. 1, the volute casing 1 comprises the volute chamber 2 for receiving the impeller 103 and an outlet passage 3 for guiding the liquid to the outlet 102. The flow of liquid coming from the inlet 101 enters the volute chamber 2 generally in the axial direction A and is then diverted by the impeller 103 in a circumferential direction. As it is characteristic for a volute casing, the distance between the inner wall delimiting the volute chamber 2 and the central axis C of the volute casing 1 increases when viewed in the flow direction towards the outlet passage 3, thus building a flow channel for the liquid which flow channel that widens in flow direction. The volute casing 1 further comprises at least a first cutwater 4 for directing the liquid into the outlet passage 3, i.e. the first cutwater 4 divides the flow channel such that the liquid flows along both sides of the cutwater 4. The cutwater 4 is also referred to as splitter rib or as cutwater tongue or simply as tongue. The embodiment shown in FIG. 1 is configured with two cutwaters and comprises, a part from the first cutwater 4, a second cutwater 4' which is arranged at a location 180° displaced with respect to the location of the first cutwater 4 when viewed in the circumferential direction of the volute chamber 2. The design with two cutwaters 4, 4' as such is known in the art and therefore does not require a more detailed explanation. The main reason for providing two cutwaters 4, 4' in the volute casing 2 is the balancing of the radial thrust acting upon the impeller 103.

Although the embodiment described here, comprises a first and a second cutwater 4, 4' it has to be understood that the invention also comprises such embodiments in which the volute casing 1 is designed with only one cutwater.

Each cutwater 4, 4' comprises an inner surface 41 facing the central axis C, an outer surface 42 facing away from the central axis C and a leading edge 43 which is the axially extending edge of the cutwater 4, 4' facing the flow of liquid, i.e. at the leading edge 43 the flow of liquid is split. The leading edge 43 constitutes the upstream end of the cutwater 4, 4'. Thus, the inner surface 41 of the respective cutwater 4, 4' is that lateral surface of the cutwater 4, 4' which is closer to the central axis C and the outer surface 42 of the respective cutwater 4, 4' is that lateral surface of the cutwater 4, 4' which is farer away from the central axis C. The leading edge 43 is joining the inner surface 41 and the outer surface 42.

Figure 3:
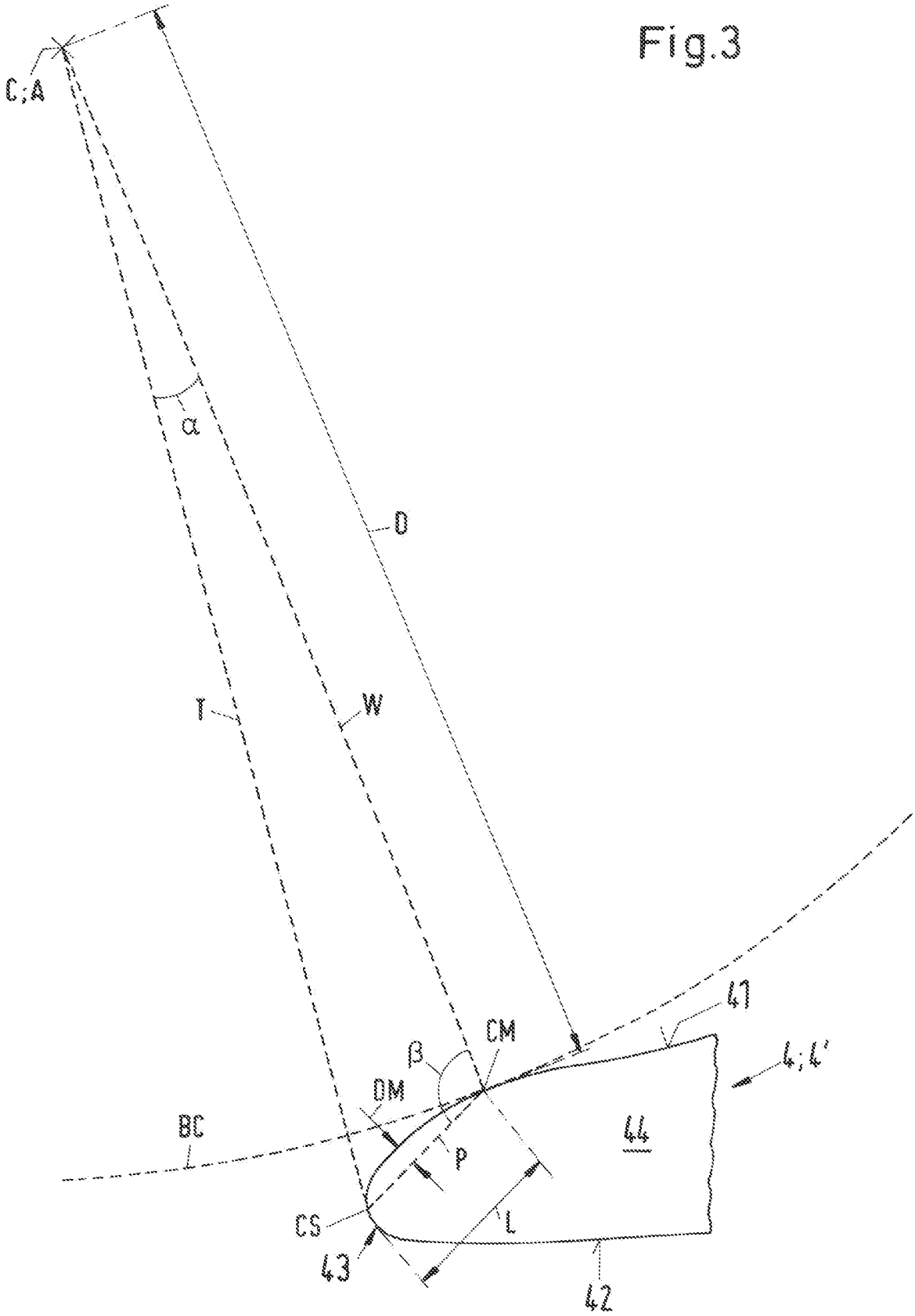
FIG. 3 is an enlarged view of the upstream end of the cutwater in a cross-sectional view in the midplane of the cutwater.

Referring now to FIG. 3 the design of the cutwater 4, 4' and in particular the design of the inner surface 41 near the leading edge 43 will be described in more detail. It goes without saying that this description applies both for the first cutwater 4 and for the second cutwater 4' FIG. 3 shows an enlarged view of the upstream end of the cutwater 4, 4', which is the end comprising the leading edge 43 of the cutwater 4, 4'. FIG. 3 represents a cross-section through the cutwater 4, 4' perpendicular to the axial direction A in a section plane coinciding with a midplane of the cutwater 4, 4' The midplane is perpendicular to the axial direction A and represents the geometrical center plane of the cutwater 4, 4' with respect to the axial direction A. In FIG. 3 the drawing plane coincides with the midplane. The design of the cutwater 4, 4' in the midplane is represented by the cross-sectional contour 44 of the cutwater 4, 4' in the midplane. The midplane and more precisely the cross-sectional contour 44 comprise a cutwater starting point CS and a cutwater minimum point CM.

The cutwater starting point CS is located on the leading edge 43, and the midplane (or the cross-sectional contour 44, respectively). The cutwater starting point CS is defined by that point of the cross-sectional contour 44 at which a tangent T to the leading edge 43 exists, that orthogonally intersects the central axis C.

The cutwater minimum point CM is located on the inner surface 41, more precisely at the intersection of the inner surface 41 and the midplane (or the cross-sectional contour 44, respectively). The cutwater minimum point is defined by that point located both in the midplane (or the cross-sectional contour 44, respectively) and on the inner surface 41, at which the inner surface 41 has a minimum distance D from the central axis C, as measured in the midplane.

As can be seen in FIG. 3 the inner surface 41 of the cutwater 4, 4' is designed such that the distance D of the inner surface 41 from the central axis C continuously decreases when moving along the inner surface 41 from the cutwater starting point CS to the cutwater minimum point CM. At the cutwater minimum point CM, the distance D reaches its minimum and increases upon further moving away from the leading edge 43 beyond the cutwater minimum point CM. The inner surface 41 is designed as a smooth and curved surface having a minimum distance D from the central axis C at the cutwater minimum point CM.

FIG. 3 further shows a profile chord P defined as a straight line in the cross-sectional contour 44 extending from the cutwater starting point CS to the cutwater minimum point CM. The length L of the profile chord P is the distance between the cutwater starting point CS and the cutwater minimum point CM. Due to the curved design of the inner surface 41 the orthogonal distance between the straight profile chord P and the inner surface 41 varies between the cutwater starting point CS and the cutwater minimum point CM. The inner surface 41 is designed and curved in such a manner that the orthogonal distance of the profile chord P from the inner surface 41 first increases when moving from the cutwater starting point CS to the cutwater minimum point CM, reaches a maximum orthogonal distance DM, and then decreases to zero at the cutwater minimum point CM. According to the invention, the maximum orthogonal distance DM between the profile chord P and the inner surface 41 is at most 15%, and preferably at most 13% of the length L of the profile chord P. In the embodiment shown in FIG.

3 the maximum orthogonal distance DM equals approximately 13% of the length L of the profile chord P.

Another preferred feature of the design of the cutwater 4, 4' is related to the distance between the cutwater starting point CS and the cutwater minimum point CM. The distance is determined by an angular distance that is measured on the midplane by an angle α. The angle α is the angle between the tangent T to the leading edge 43 and a straight line W perpendicular to the axial direction A, or the central axis C, respectively, wherein the straight line W connects the cutwater minimum point CM with the central axis C. This angle α measuring the angular distance between the cutwater starting point CS and the cut water minimum point CM is at least 5.5° and preferably at least 6.5°. In the embodiment shown in FIG. 3 the angle α measuring the angular distance between the cutwater starting point CS and the cut water minimum point CM equals approximately 6.5°.

Still another preferred feature of the design of the cutwater 4, 4' is related to the inclination of the profile chord P. The inclination is measured on the midplane by an inclination angle β which is defined as the angle between the profile chord P and the straight line W, i.e. the line perpendicular to the axial direction A and connecting the cutwater minimum point CM with the central axis C. Preferably, the inclination angle β is at least 110° and more preferred at least 114°. In the embodiment shown in FIG. 3 the inclination angle β equals approximately 114°.

According to a further advantageous measure, the inner surface of the cutwater 4, 4' is designed in such a manner that the cutwater minimum point CM constitutes an absolute minimum in the distance D of the cross-sectional contour 44 from the central axis C, i.e. there is no other point on the cross-sectional contour 44 at which the distance D of the inner surface 41 from the central axis C is smaller than or equals the distance D at the cutwater minimum point CM. That is, the cross-sectional contour 44 and a basic circle BC are tangent to each other at the cutwater minimum point CM, wherein the basic circle BC is defined by having its center on the central axis C and a radius that equals the distance D between the central axis C and the cutwater minimum point CM, which is the minimum of the distance D. The basic circle BC lies in the midplane. The outer surface 42 of the cutwater 4, 4' may be designed in any known manner.

The volute casing according to an embodiment of the invention, and in particular the configuration of the inner surface 41 of the cutwater 4, 4' in the area adjacent to the leading edge 43, considerably reduces the risk of cavitation at the cutwater 4, 4' where the flow velocity of the liquid conveyed by the centrifugal pump 100 is very high. Especially when the centrifugal pump 100 is operated in a part-load region, i.e. away from the pump's 100 best efficiency point, and the pump 100 is generating a smaller flow rate than the flow rate the pump 100 is designed for, the configuration of the inner surface 41 avoids the occurrence of local velocity peaks or at least considerably reduces the velocity peaks, which usually exist in known designs. It has been found that such local velocity peaks in known designs predominantly occur at the inner surface of the cutwater in a region downstream of the leading edge of the cutwater.

By the volute casing 1 according to the invention with the new design of the inner surface 41 downstream of the leading edge 43 the local velocity of the fluid is reduced in the critical areas of the inner surface 41 of the cutwater 4, 4' in particular in a part-load operation of the pump 100. Reducing the velocity of the fluid, or avoiding the local velocity peaks, increases the local static pressure of the fluid in these locations. More precisely, the difference between the suction pressure at the inlet 101 of the pump 100 and the local static pressure at the inner surface 41 of the cutwater 4, 4' is increased. Consequently, the local static pressure at the inner surface 41 of the cutwater 4, 4' falling below the vapor pressure of the liquid can be avoided (or at least the risk is considerably reduced). Thus, cavitation is efficiently avoided without the need to increase the suction pressure. This results in safer and better operation of the pump 100 by avoiding cavitation induced effects such as increased vibrations, noise, instabilities in the head performance curve, reduced differential head and severe erosion effects reducing the lifetime of the volute casing.

The invention claimed is:

1. A volute casing for a centrifugal pump, the volute casing having a central axis defining an axial direction, comprising:

a volute chamber configured to receive an impeller for rotation about the axial direction;

an outlet passage configured to discharge a fluid; and a first cutwater configured to direct the fluid to the outlet passage, the cutwater comprising an inner surface facing the central axis, an outer surface facing away from the central axis and a leading edge joining the inner surface and the outer surface, the cutwater having a cross-sectional contour in a midplane perpendicular to the axial direction, the cross-sectional contour comprising a cutwater starting point at the leading edge, and a cutwater minimum point on the inner surface, the cutwater starting point being defined by a tangent to the leading edge, the tangent intersecting the central axis, and the cutwater minimum point being defined by a location, at which the inner surface has a minimum distance from the central axis, the cutwater being configured such that a straight profile chord located in the cross-sectional contour, and extending from the cutwater starting point to the cutwater minimum point, has a maximum orthogonal distance from the inner surface, the maximum orthogonal distance being at most 15% of the length of the profile chord, and an angular distance between the cutwater starting point and the cutwater minimum point measured on the midplane by an angle between the tangent to the leading edge through the cutwater starting point and a straight line connecting the cutwater minimum point with the central axis is at least 5.5°.

2. The volute casing in accordance with claim 1, wherein the maximum orthogonal distance of the profile chord from the inner surface is approximately 13% of the length of the profile chord.

3. The volute casing in accordance with claim 1, wherein the inner surface of the cutwater is curved such that the orthogonal distance of the profile chord from the inner surface first increases when moving from the cutwater starting point to the cutwater minimum point, reaches the maximum orthogonal distance, and then decreases to zero at the cutwater minimum point.

4. The volute casing in accordance with claim 1, wherein the angular distance between the cutwater starting point and the cutwater minimum point is approximately 6.5°.

5. The volute casing in accordance with claim 1, wherein the inner surface of the cutwater is configured such that the cross-sectional contour and a basic circle are tangent to each other at the cutwater minimum point, the basic circle being centered on the central axis and having a radius equal to a distance between the central axis and the cutwater minimum point.

6. The volute casing in accordance with claim 1, further comprising a second cutwater configured to direct the fluid to the outlet passage, the second cutwater comprising an inner surface facing the central axis, an outer surface facing away from the central axis and a leading edge joining the inner surface and the outer surface, and the inner surface of the second cutwater being analogously designed as the inner surface of the first cutwater at least between the leading edge and the cutwater minimum point.

7. A centrifugal pump comprising:

a volute casing, according to claim 1; and an impeller arranged in the volute casing.

8. The volute casing in accordance with claim 1, wherein the maximum orthogonal distance is at most 13% of the length of the profile chord.

9. The volute casing in accordance with claim 1, wherein the angular distance between the cutwater starting point and the cutwater minimum point is at least 6.5°.

10. The volute casing in accordance with claim 1, wherein an inclination angle measured on the midplane between the profile chord and a straight line connecting the cutwater minimum point with the central axis is at least 114°.

11. The volute casing for a centrifugal pump, the volute casing having a central axis defining an axial direction, comprising:

a volute chamber configured to receive an impeller for rotation about the axial direction;

an outlet passage configured to discharge a fluid; and a first cutwater configured to direct the fluid to the outlet passage, the cutwater comprising an inner surface facing the central axis, an outer surface facing away from the central axis and a leading edge joining the inner surface and the outer surface, the cutwater having a cross-sectional contour in a midplane perpendicular to the axial direction, the cross-sectional contour comprising a cutwater starting point at the leading edge, and a cutwater minimum point on the inner surface, the cutwater starting point being defined by a tangent to the leading edge, the tangent intersecting the central axis, and the cutwater minimum point being defined by a location, at which the inner surface has a minimum distance from the central axis, the cutwater being configured such that a straight profile chord located in the cross-sectional contour, and extending from the cutwater starting point to the cutwater minimum point, has a maximum orthogonal distance from the inner surface, the maximum orthogonal distance being at most 15% of the length of the profile chord, and an inclination angle measured on the midplane between the profile chord and a straight line connecting the cutwater minimum point with the central axis is at least 110°.

12. The volute casing in accordance with claim 11, wherein the inclination angle is approximately 114°.

13. The volute casing in accordance with claim 11, wherein an inclination angle measured on the midplane between the profile chord and a straight line connecting the cutwater minimum point with the central axis is at least 114°.

* * * * *